United States Patent [19]

Beall

[11] 3,956,510

[45] *May 11, 1976

[54] PACKAGE FOR UNIFORMLY SHAPED CHIP SNACK FOOD PRODUCTS

[76] Inventor: Nelson J. Beall, Albertville, Minn.

[ * ] Notice: The portion of the term of this patent subsequent to Dec. 3, 1991, has been disclaimed.

[22] Filed: Nov. 20, 1974

[21] Appl. No.: 525,535

Related U.S. Application Data

[63] Continuation-in-part of Ser. No. 352,811, April 19, 1973, Pat. No. 3,852,485, which is a continuation-in-part of Ser. No. 159,891, July 6, 1971, abandoned.

[52] U.S. Cl. ..... 426/106; 206/303; 206/45.31; 229/2.5; 426/110; 426/115; 426/412

[51] Int. Cl.[2] ..... B65B 23/00

[58] Field of Search ..... 426/106, 115, 145, 121, 426/110, 112, 119; 206/303, 304; 229/2.5

[56] References Cited

UNITED STATES PATENTS

| | | | |
|---|---|---|---|
| 2,660,529 | 11/1953 | Bloom | 426/106 |
| 3,128,030 | 4/1964 | Davies | 229/2.5 |
| 3,212,907 | 10/1965 | Caprioli | 426/115 X |
| 3,265,280 | 8/1966 | Butzko | 229/2.5 |
| 3,322,267 | 5/1967 | Weiss | 206/65 |
| 3,438,826 | 4/1969 | Van Elkeren et al. | 229/2.5 |
| 3,498,798 | 3/1970 | Baur et al. | 426/124 |
| 3,740,238 | 6/1973 | Graham | 229/2.5 |
| 3,852,485 | 12/1974 | Beall | 426/115 X |

*Primary Examiner*—Frank W. Lutter
*Assistant Examiner*—Steven L. Weinstein
*Attorney, Agent, or Firm*—Anthony A. Juettner

[57] ABSTRACT

Snacked chips of uniform shape and size are nested one within another in closely fitting relationship in a form of a circular or loop array.

3 Claims, 12 Drawing Figures

FIG. I
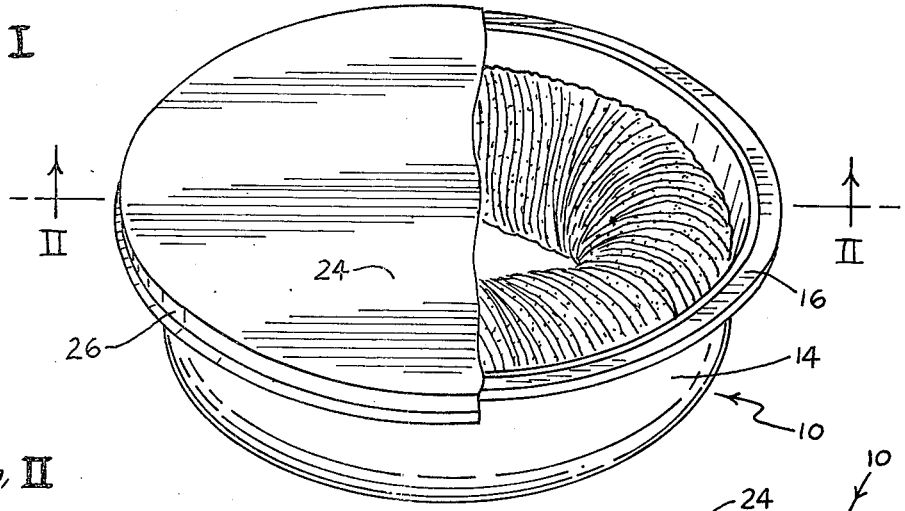
FIG. II
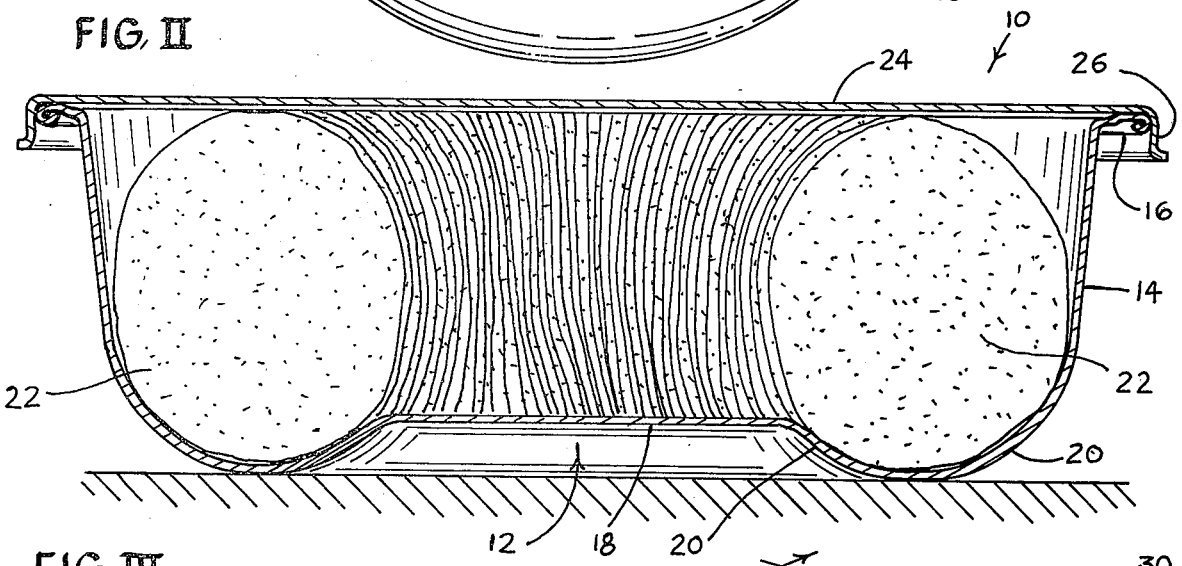
FIG. III
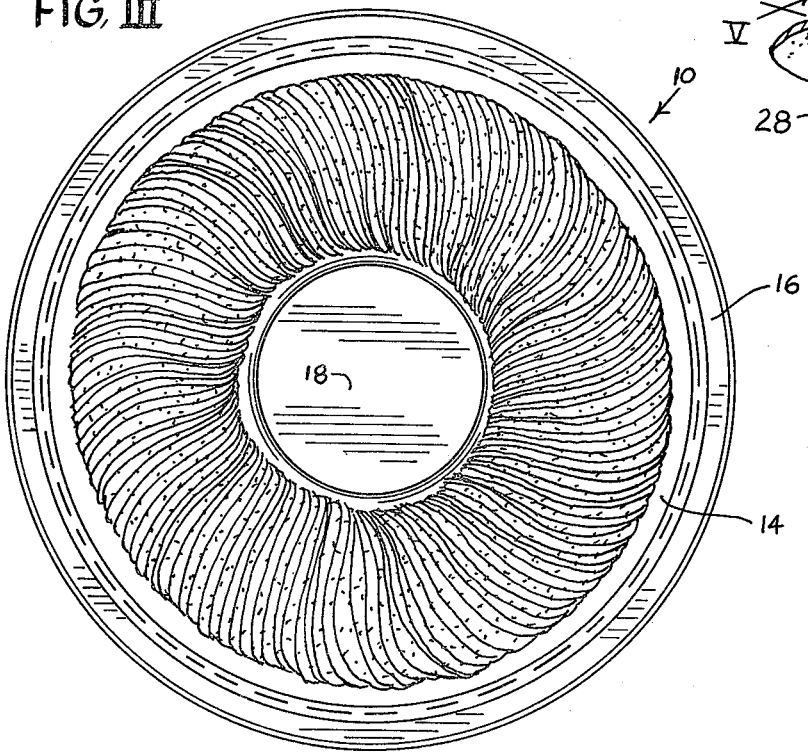
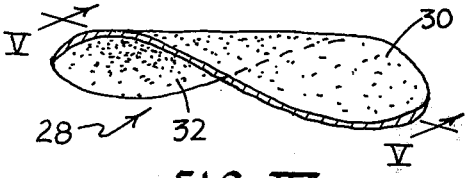
FIG. IV
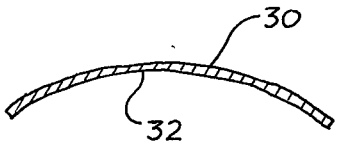
FIG. V FIG. VI
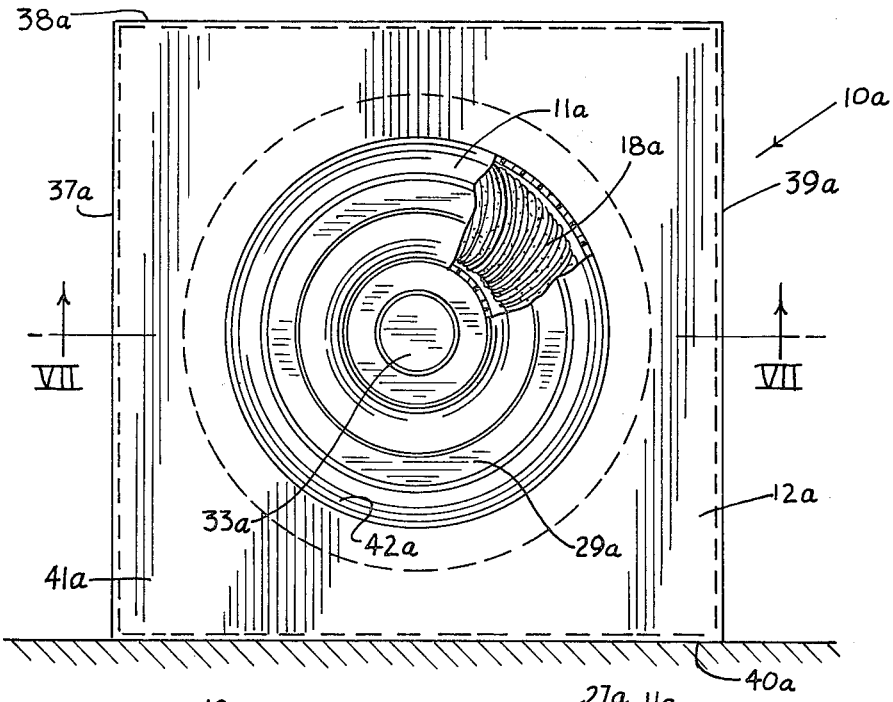
FIG. VII
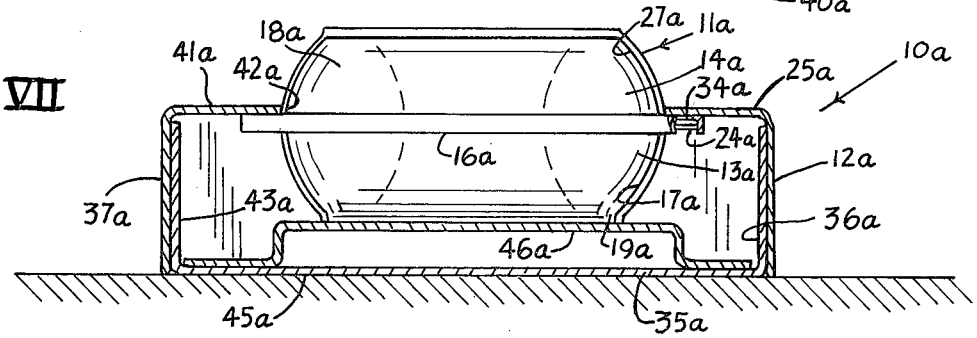
FIG. VIII
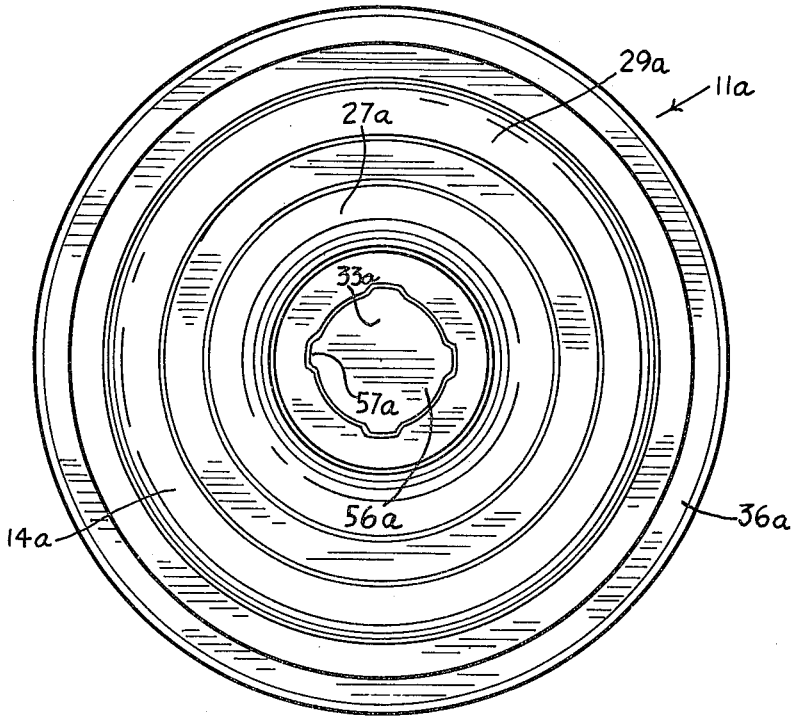

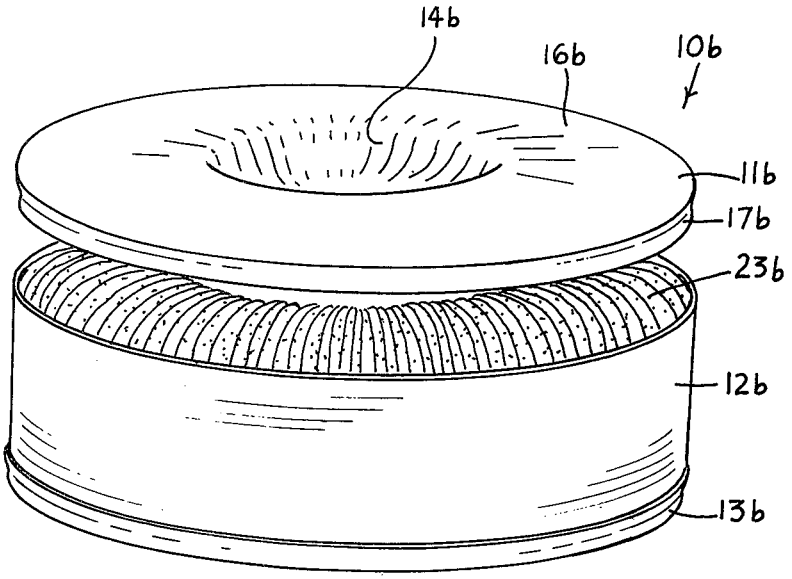
FIG. IX
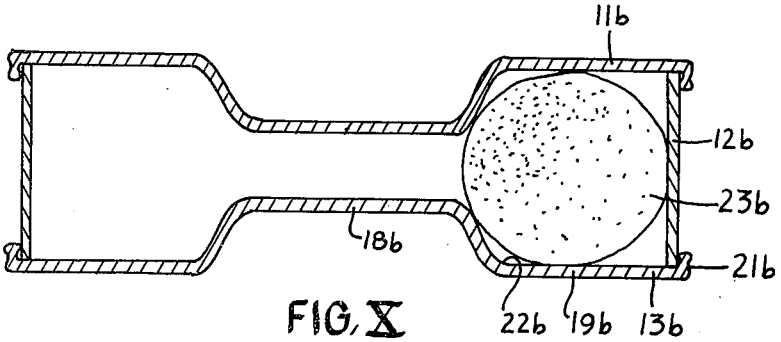
FIG. X

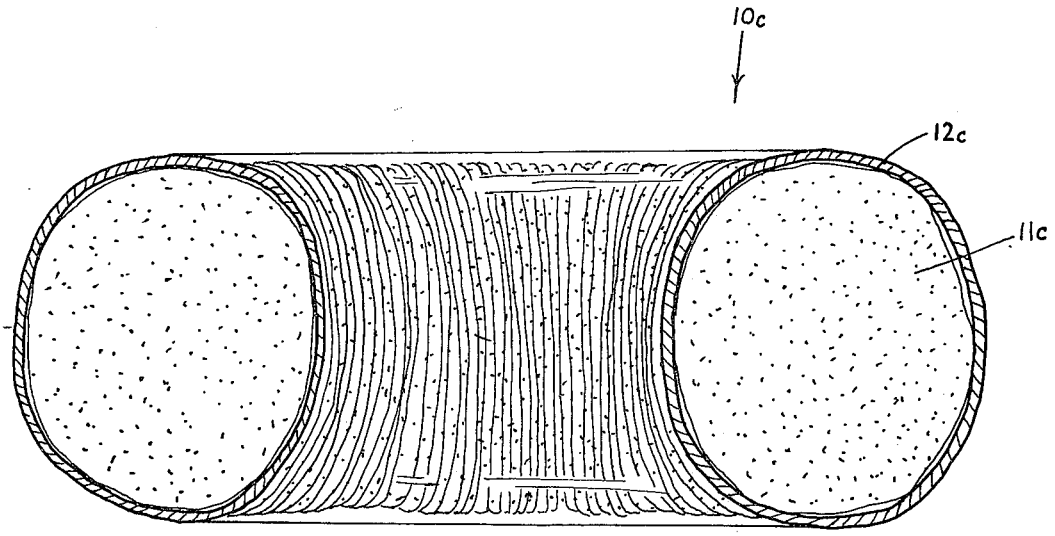
FIG. XI
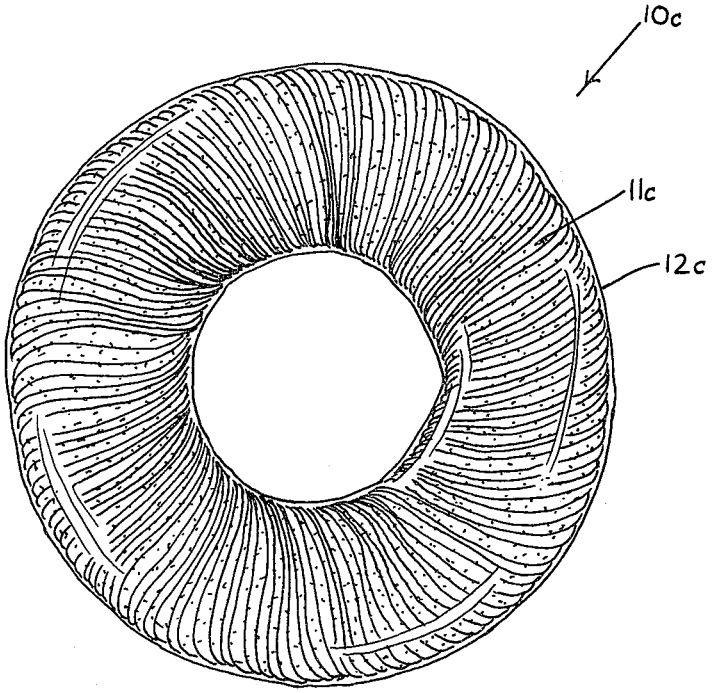
FIG. XII

PACKAGE FOR UNIFORMLY SHAPED CHIP SNACK FOOD PRODUCTS

This is a continuation-in-part of U.S. Pat. application Ser. No. 352,811 filed Apr. 19, 1973, now U.S. Pat. No. 3,852,485, which is a continuation-in-part of Pat. application Ser. No. 159,891 filed July 6, 1971, now abandoned.

The present invention relates to food products and more particularly to a package of shaped snack products. The packaging of snack chips such as potato chips has in the past involved placing irregularly shaped chips into a bag in a random unoriented manner. Such bags are made typically from one or more sheets of waxed paper or glassine. Although this type of bag is relatively inexpensive, it provides little protection for the fragile chips during handling and shipping. Thus, it is quite common to have a number of broken chips in the bag. Another possible package for chip type snacks of uniform shape and size involves vertically stacking the chips one upon the other to form a straight column. The column may be placed within a substantially rigid tubular container. The tubular container may be sealed closed by securing ends thereto. It has been found that when such container is dropped on its bottom (i.e., one of such ends) the chips nearest such end tend to break. Broken chips do not normally meet with consumer acceptance.

Accordingly, it is one object of the present invention to provide a protective package for uniformly shaped fragile chip type snack food products which will prevent breakage of such items while in shipment and during handling. It has been found that chip breakage is reduced when the chips are supported on their edges. In other words, the chips are disposed in the package with their major surfaces perpendicular to the bottom of the supporting portion of the container. The present invention contemplates a loop array of nested uniform chips and packaging suitable for maintaining the chips in the loop array. The present invention in the circular or loop array provides protection regardless of the direction from which the package is dropped.

Other objects and advantages of the invention will be apparent from the following description in which certain preferred embodiments are disclosed.

FIG. I is an elevational view of the package according to the present invention partially broken away to show the arrangement of the contents within the container;

FIG. II is a cross sectional view of the package shown in FIG. I taken along the line II—II;

FIG. III is a top view of the package shown in FIG. I with the top removed;

FIG. IV is a perspective view of one form of chip which may be contained in the present packaging;

FIG. V is a cross sectional view of the chip shown in FIG. IV taken along the line V—V;

FIGS. VI–VIII show an embodiment of the present invention including a container caddy;

FIGS. IX and X show another embodiment of the present invention; and

FIGS. XI and XII show a further embodiment.

Referring now to the drawings, FIGS. I–III show a container 10 having a bottom 12 of circular shape, an upstanding side wall 14 and an outwardly extending top flange 16. The bottom 12 has a raised portion 18 and curved portion 20. The side walls 14 and curved portion 20 are designed to substantially conform to the outside curvature and bottom configuration respectively of a chip-type snack food product 22 to be packaged therein.

The outwardly extending top flange 16 is adapted to hold a cover 24 in place across the top of the container 10. The cover 24 is snugly fit over the flange 16 by means of a downwardly extending lip 26. The container 10 and cover 24 can be constructed of any material that may be formed, such as metal, plastic, paper or combination thereof, and which is sufficiently strong and rigid to withstand handling and shipping loads. Drawn aluminum has been used to make a container 10 while pressed board lined with aluminum foil has been used to make a cover 24. The cover 24 may also be secured to the flange 16 by gluing, heat sealing or other adhesive means.

It is an essential element of the present invention that the chip products to be packaged are thin and substantially uniform in shape and size so they may be nested one within the other to form a loop, preferably a closed loop. Desirably, the closed loop is in the form of a circular array.

FIGS. IV and V illustrate a type of uniform chip product which can be successfully packaged according to the present invention. The product 28 may have an upper curved major surface 30 and a lower curved major surface 32. The surfaces 30 and 32 are formed from single curves in FIG. IV. Alternatively, the products may have upper and lower major surfaces curved in each of two orthogonal planes. Although many shaped variations within this framework are possible, it is desirable in the marketing of potato chips or similar products to use the general shape in which such products are presently marketed since that is a form with which customers are familiar.

Another embodiment is disclosed in FIGS. VI–VIII, the package 10*a* may include a chip container 11*a* and a container caddy 12*a*. The container 11*a* may include a lower member 13*a*, an upper member 14*a* and a locking device 16*a*. The terms "upper," "lower" and the like when used in describing the present invention will be in reference to the package or container as positioned in FIG. VII. The terms "radially outer" and "radially inner" when used in describing the present invention will be in reference to the package or container as shown in FIGS. VI and VIII. The portions 13*a* and 14*a* may be formed from any suitable material which may be shaped and will not adversely affect the edible contents (e.g. does not result in toxicity). The material should not result in a taste or an odor transfer to the chips. Preferably the material provides visability of the contents and desirably provides an oxygen and moisture barrier. The portions 13*a* and 14*a*, for example, may be vacuum formed from polyvinyl chloride film. Alternatively, one member such as 14*a* may be of a nontransparent material such as aluminum or high density polyethylene. The other member 13*a* may be a transparent material such as polyvinyl chloride. The member 13*a* has a channel 17*a* which conforms substantially to the shape of the lower portion of the nested chips 18*a*, for example, U-shaped. The channel 17*a* is defined by a radially inner wall and a radially outer wall. It is desirable that the chips fit snugly into the channel 17*a*. Member 13*a* may include a rib 19*a* for purposes of strengthening the container 11*a*. The rib 19*a* permits distribution of support of the chips along the lower side edges of the chips rather than principally on the lower tip of the chips. Member 13*a* has a center flange or web 23*a* and an outwardly extending flange 24*a* for purposes hereinafter described. Member 14*a* may be constructed somewhat similar to member 13*a* and includes a channel 27*a* which is shaped substantially like the upper portion of the nested chips 18*a*, such as U-shaped. In other words, a member 14*a* has a radially inner wall and a radially outer wall. It is desirable that the chips fit snugly into channel 27*a*. Member 14*a* may include a rib 29*a* for purposes of strengthening the member 14*a*. The member 14*a* has a center flange or web 33*a* and an outwardly extending flange 34*a*. The members 13*a* and 14*a* may be secured or locked together in any of a variety of ways. The simplest method is to secure such portions together by applying a strip of tape to over-lie the edges of flanges 24*a* and 34*a*. The tape may be applied by hand. Alternatively, various locking devices may be built into the portions 13*a* and 14*a*.

The container 11*a* shown in FIGS. VI–VII further includes a snap lock ring 16*a* for holding the members 13*a* and 14*a* together when the container is closed. The members 13*a* and 14*a* may be held together by snap locks 56*a* and 57*a* provided in the center webs 23*a* and 33*a* (as shown in FIG. VIII).

If desired, the container 11*a* may be mounted in a container caddy 12*a*. The caddy 12*a* may be constructed of paper board and has a first member 25*a* and a second member 35*a*. The member 25*a* may include four side walls 37*a*, 38*a*, 39*a*, and 40*a*. The member 25*a* further includes the upper wall 41*a*, and has an opening 42*a* through which a portion of container 11*a* may extend. The opening 42*a* is not so large as to permit the flanges 24*a* and 34*a* to pass therethrough.

The member 35*a* may be constructed similar to member 25*a* and includes side walls such as 43*a* and 44*a* (FIG. VII). The member 35*a* further includes a lower wall 45*a*. Member 35*a* is slightly smaller than member 25*a* so that member 25*a* may slide snugly over member 35*a*. Member 35*a* may have a platform or spacer 46*a*. The container 11*a* thus may be held between the spacer 46*a* and upper wall 41*a*. The members 25*a* and 35*a* may be secured together by small portions of tape. The caddy 12*a* permits display of the container 11*a* in various positions, for example, the package 10*a* may be displayed in the vertical position as shown in FIG. VI or the horizontal position as shown in FIG. VII. Promotional and instructional information may be printed on the caddy 12*a*.

A further embodiment of the present invention is shown in FIGS. IX and X. Container 10*b* may include an upper member 11*b*, a lower member 13*b* and an interconnecting member 12*b*. The upper member 11*b* may include an inwardly extending central portion 14*b* for purposes hereinafter described. The member 11*b* includes a flat radially outwardly extending portion 16*b* and a snap portion 17*b*.

The lower member 13*b* may be constructed identical to upper member 11*b* and may include a central inwardly extending portion 18*b*, a radially outwardly extending portion 19*b* and a snap portion 21*b*. Portions

11*b* and 13*b* may be suitably prepared from polyethylene or polyvinyl chloride sheet material (such as by vacuum forming). The inner connecting portion 12*b* may comprise a short tube or sleeve member. The member 12*b* may be constructed of paper board or a polyethylene material. As shown in FIG. 1, the members 11*b* and 12*b* simply snap onto the sleeve member 12*b*. If desired, either or both may be secured to sleeve member 12*b* with a suitable adhesive material. As shown, the container 10*b* does provide a circular channel 22*b* in which the ring of chips may be contained.

A further embodiment is shown in FIGS. XI and XII. The package 10*c* includes the ring of chips 11*c* and a shrink wrap material 12*c* surrounding the ring of chips 11*c*. The shrink wrap 12*c* serves to maintain the nested chips in desired circular or loop array configuration.

It has been found that single curved chips when stacked one upon another have a small gap between the inner surface of one chip and the outer surface of the next chip. This may be true of each of the chips in a stack. An impact on either end of such a stack tends to flex the chip to eliminate the small gap. Such flexing breaks the chips. If the chips are so positioned in the package that they receive the impact on the edges of the chip the flexing is reduced or eliminated and in turn, the breakage is reduced or eliminated. A closed circular array or a closed loop array has no beginning and no ending and consequently, eliminates that possibility of an impact on the end of the package. An impact on a circular array is on the edges of the chips regardless of the direction from which the impact is received. Moreover, chips placed in a circular or loop array tend to shingle which reduces or eliminates the small gap between the chips. Thus the present invention provides a circular array or a loop array of nested chips which is highly resistent to breakage. The present invention provides packaging which is suitable for maintaining the chips in such a loop or circular array.

Although several specific examples have been described, the present invention includes a wide variety of other embodiments which are within the scope of the following claims.

The embodiments of the invention in which an exclusive property or privilege is claimed are defined as follows:

1. A filled container of uniformly shaped chip type snack food products, said filled container comprising a plurality of nested chips of substantially uniform shape and size, each of said chips having its major surfaces thereof positioned in abutting relationship with major surfaces of the adjacent chips, said nested chips being in a loop array; and container means substantially surrounding said loop array to maintain said nested chips in said loop array.

2. The container of claim 1 wherein said chips have major surfaces comprising a single curve.

3. The container of claim 1 wherein said loop array is a circular array.

* * * * *